US008479755B2

(12) United States Patent
Hung

(10) Patent No.: US 8,479,755 B2
(45) Date of Patent: Jul. 9, 2013

(54) AMBULATORY AID

(75) Inventor: Chi-Wei Hung, Tainan (TW)

(73) Assignee: Gentry Way Co., Ltd., Tainan (TW)

( * ) Notice: Subject to any disclaimer, the term of this patent is extended or adjusted under 35 U.S.C. 154(b) by 75 days.

(21) Appl. No.: 13/299,422

(22) Filed: Nov. 18, 2011

(65) Prior Publication Data

US 2013/0125943 A1 May 23, 2013

(51) Int. Cl.
*A45B 9/00* (2006.01)
*A61H 3/02* (2006.01)

(52) U.S. Cl.
USPC ..... 135/75; 135/65; 135/67; 135/82

(58) Field of Classification Search
USPC ..... 135/65, 67, 75, 82; 248/188.1, 188.5, 248/188.8, 125.8; 403/109.1–109.4, 109.7
See application file for complete search history.

(56) References Cited

U.S. PATENT DOCUMENTS 2,528,706 A * 11/1950 Osborn ..... 135/69
2,899,968 A * 8/1959 Reichenbach ..... 135/65
5,529,425 A * 6/1996 Spies et al. ..... 403/322.4
5,692,533 A * 12/1997 Meltzer ..... 135/65
6,595,226 B2 * 7/2003 Uemura ..... 135/75
6,886,575 B2 * 5/2005 Diamond ..... 135/74
7,360,547 B2 * 4/2008 Carlson ..... 135/66
2010/0170548 A1 * 7/2010 Lenhart ..... 135/75

FOREIGN PATENT DOCUMENTS

DE 10317829 A1 * 11/2004
WO WO 3059238 A1 * 7/2003

* cited by examiner

*Primary Examiner* — Winnie Yip
(74) *Attorney, Agent, or Firm* — Muncy, Geissler, Olds & Lowe, PLLC

(57) ABSTRACT

An ambulatory aid is revealed. The ambulatory aid includes a hollow main rod and a hollow support pole connected with each other, and a cushion unit therebetween. The main rod, the hollow support and the cushion unit all have insertion holes, aligned with each other. By insertion pins inserted into the insertion holes, the main rod, the hollow support and the cushion unit are assembled with each other. The structure of the assembly of the main rod, the hollow support and the cushion unit is more firm and tighter. When the ambulatory aid is pressed by a larger pressure, the assembly will not come loose and move around and the unstable walking stick makes the users fall down due to a loss of support.

16 Claims, 9 Drawing Sheets

AMBULATORY AID

BACKGROUND OF THE INVENTION

1. Field of the Invention

The present invention relates to an ambulatory aid, especially to an ambulatory aid having a tight and firm structure for preventing instability and providing high safety.

2. Description of Related Art

Refer to FIG. 9, this is a walking stick for old people who have low-level moving activity due to poor physical function or people with wounded legs. The walking stick mainly includes a hollow main rod 6 and a support pole 7. A cushion unit 8 is arranged between the main rod 6 and the support pole 7. The cushion unit 8 consists of a sleeve 81, an assembly rod 82, an elastic body 83 and a support block 84. One end of the assembly rod 82 is connected to and fixed on the one end of the support pole 8 and the elastic body 83 is placed around the assembly rod 82 while the other end of the assembly rod 82 disposed with the support block 84 is mounted into a hollow part of the sleeve 81. Due to the support block 84, the sleeve 81 with grooves 811 around a wall thereof is forced to expand. By the expanded sleeve 81 assembled into a hollow part of the main rod 6, the main rod 6, the support pole 7 and the cushion unit 8 comprise the walking stick.

However, in the walking stick, the cushion unit 8 and the main rod 6 are connected and fixed with each other mainly by friction between the expanded sleeve 81 and an inner wall of the hollow part of the main rod 6. When the users press the walking stick downward with a larger pressure or a ground reaction force is lager than the friction between the sleeve 81 and the inner wall of the main rod 6, the connection between the cushion unit 8 and the main rod 6 has come loose, cushion unit 8 is retracted and the walking stick is getting shorter. The user easily falls down.

SUMMARY OF THE INVENTION

Therefore it is a primary object of the present invention to provide an ambulatory aid having a tight and firm structure for preventing looseness and instability at connection sites and providing higher safety.

In order to achieve the above object, an ambulatory aid of the present invention includes a hollow main rod and a hollow support pole sleeved with each other, and a cushion unit disposed between the main rod and the support pole. The main rod, the support pole, and the cushion unit all include insertion holes, corresponding to one other. And insertion pins are inserted into the corresponding insertion holes.

By the insertion pins that fix the cushion unit, the support pole and the main rod, the structure of the assembly of the main rod, the support pole and the cushion unit is more firm. Thus the user will not fall down or lose body control due to movement of the assembly caused by damaged or loose structure when the ambulatory aid is pressed by a larger pressure.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
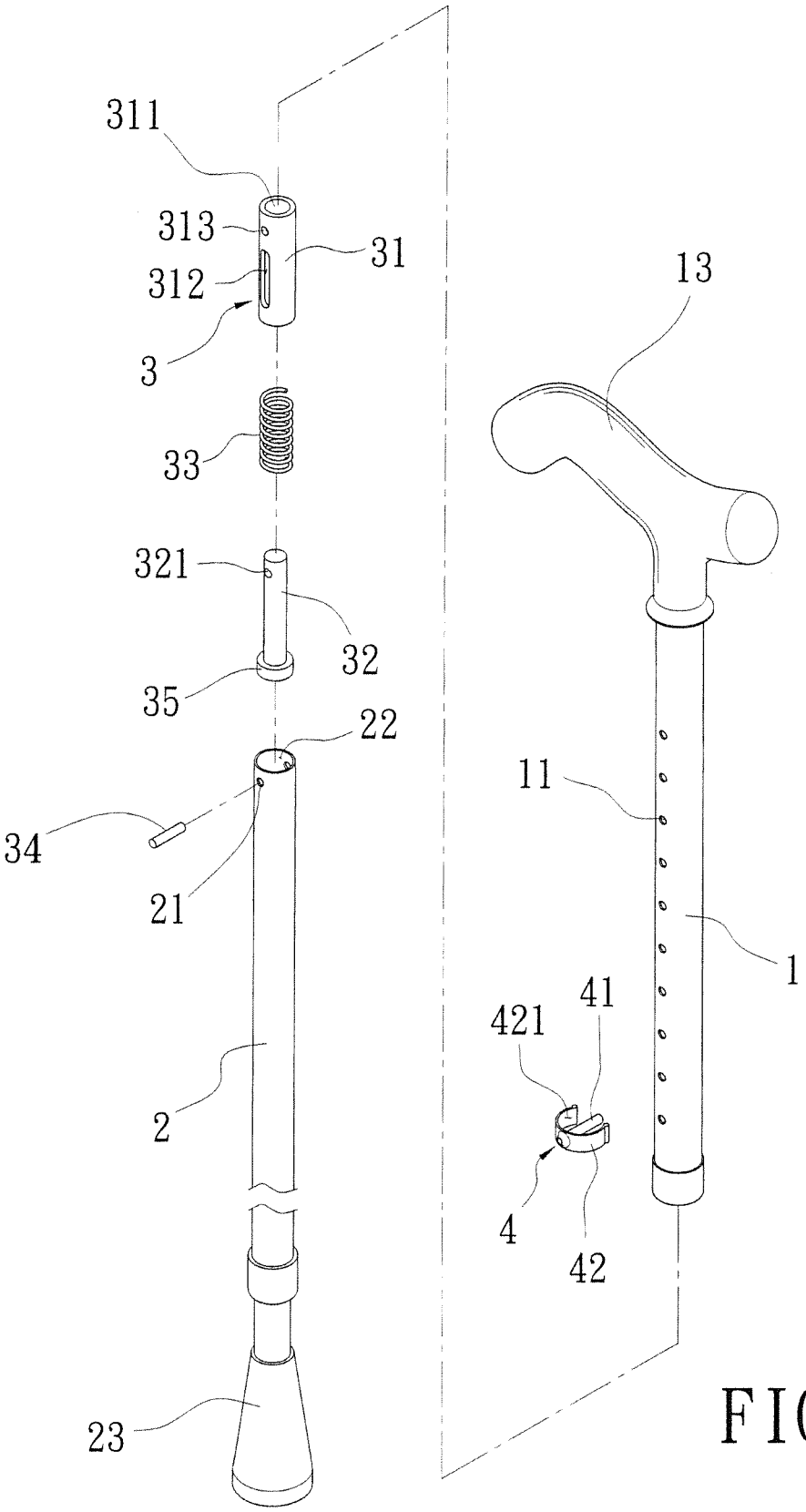
FIG. 1 is an explosive view of an embodiment according to the present invention.
Figure 2:
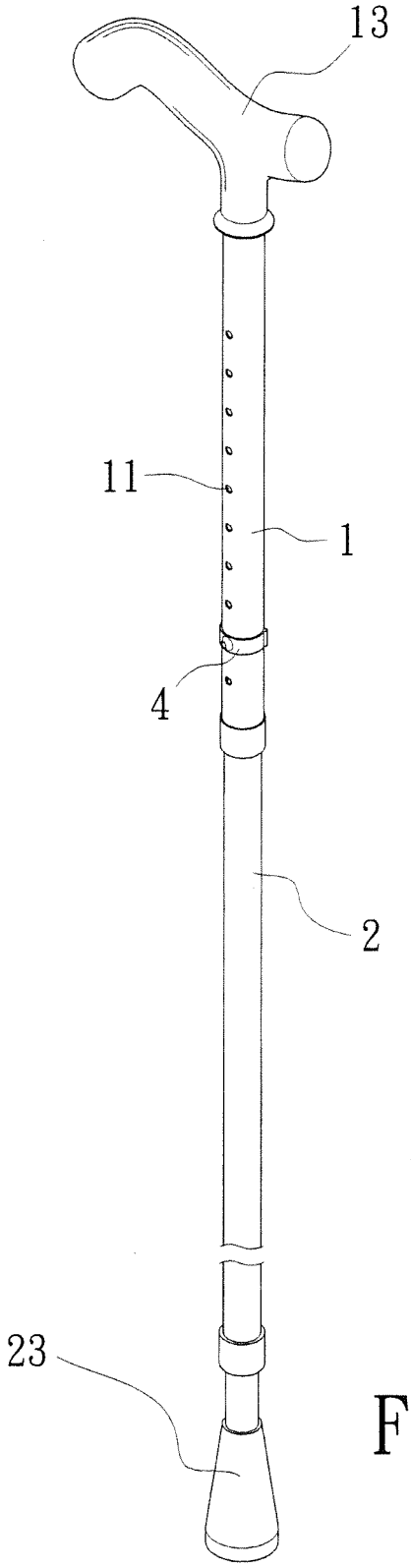
FIG. 2 is a perspective view of an embodiment according to the present invention.
Figure 3:
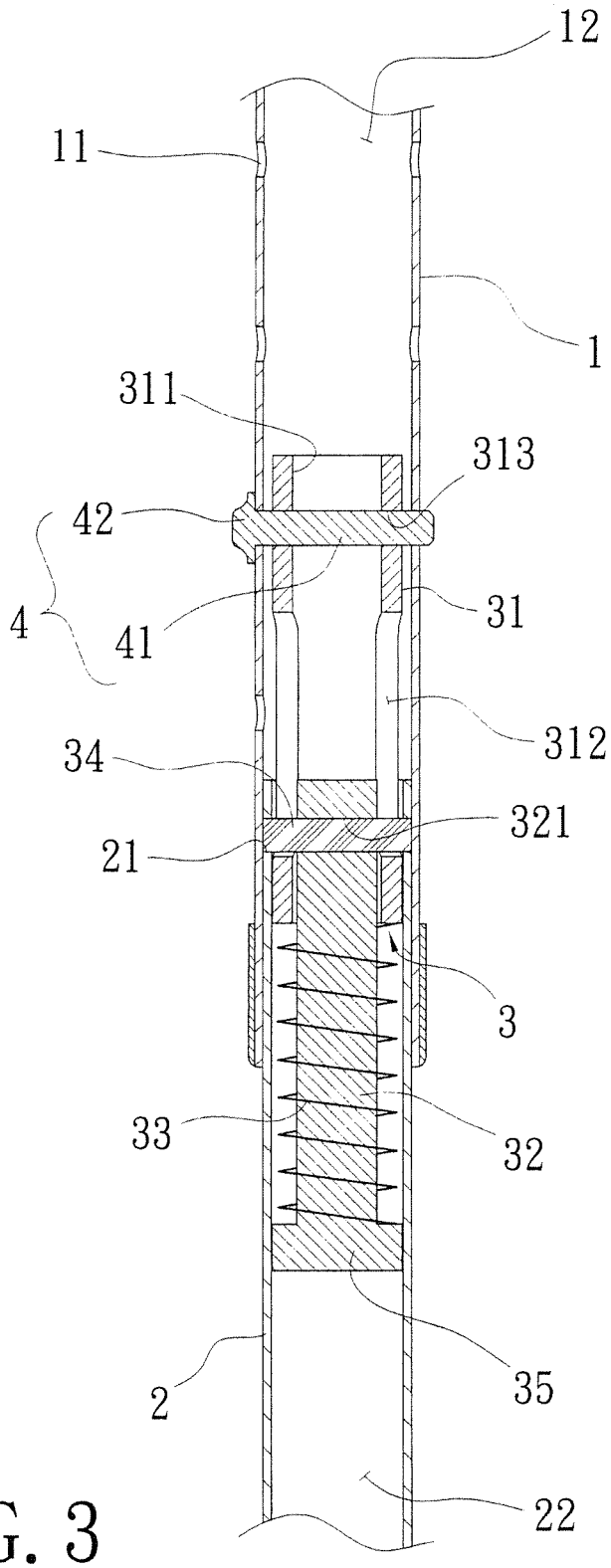
FIG. 3 is a partial cross sectional view of an embodiment according to the present invention.

Refer from FIG. 1 to FIG. 3, an ambulatory aid according to the present invention includes a main rod 1, a support pole 2, a cushion unit 3 and a fixing unit 4.

The main rod 1 is a hollow tube and having a plurality of insertion holes 11 arranged vertically on two sides thereof. The insertion holes 11 communicate with a hollow part 12 of the main rod 1. A handle part 13 is arranged on the top of the main rod 1.

The support pole 2 is a hollow tube, connected with and sleeved in the main rod 1. Each of two sides of the support pole 2 is disposed with an insertion hole 21 that communicates with a hollow part 22 of the support pole 2. An anti-slip block 23 is disposed on a bottom of the support pole 2.

The cushion unit 3 is set between the main rod 1 and the support pole 2. The cushion unit 3 is composed of a hollow sleeve 31, an assembly rod 32 and an elastic body 33. The assembly rod 32 is mounted into a hollow part 311 of the sleeve 31. One end of the assembly rod 32 for being mounted into the sleeve 31 is disposed with an insertion hole 321 and two slots 312 are respectively arranged at each of two sides of the sleeve 31. An insertion pin 34 is passed through the slots 312 of the sleeve 31 and the insertion hole 321 of the assembly rod 32. And two ends of the insertion pin 34 are inserted and mounted in the insertion holes 21 on two sides of the support pole 2. The other end of the assembly rod 32 extended from one end of the sleeve 31 is sleeved into the hollow part 22 of the support pole 2 and an against block 35 is set on this end of the assembly rod 32. The elastic body 33 is placed around the assembly rod 32. Two ends of the elastic body 33 are respectively against the against block 35 of the assembly rod 32 and one end of the sleeve 31. The other end of the sleeve 31 arranged with insertion holes 313 is mounted into the hollow part 12 of the main rod 1. The insertion holes 313 are corresponding to the insertion holes 11 of the main rod 1.

The fixing unit 4 includes an insertion pin 41, and a C-shaped holding block 42. The insertion pin 41 is passed through the insertion holes 11 of the main rod 1 and the insertion holes 313 of the sleeve 31. One end of the insertion pin 41 (that projects out of the insertion hole 11 of the main rod 1) is connected to the C-shaped holding block 42 and the C-shaped holding block 42 includes an open part 421 that is attached closely to the main rod 1.

The elder or people with wounded legs whose legs are unable to support their weight require the ambulatory aid to move around. In use, refer to FIG. 2 and FIG. 3, users can adjust the length of the ambulatory aid. During the adjustment of the ambulatory aid, user's hand holds the holding block 42 of the fixing unit 4 to pull out the fixing unit 4 from the insertion holes 11 of the main rod 1 and the insertion holes 313 of the sleeve 31 of the cushion unit 3. Then adjust the relative position of the main rod 1 to the sleeve 31 of the cushion unit 3 connected with the support pole 2 according to the user's height. After the ambulatory aid being adjusted to the required height, the insertion pin 41 of the fixing unit 4 is inserted through the insertion holes 11 of the main rod 1 and the insertion holes 313 of the sleeve 31 so as to fix the length of the ambulatory aid.

Figure 4:
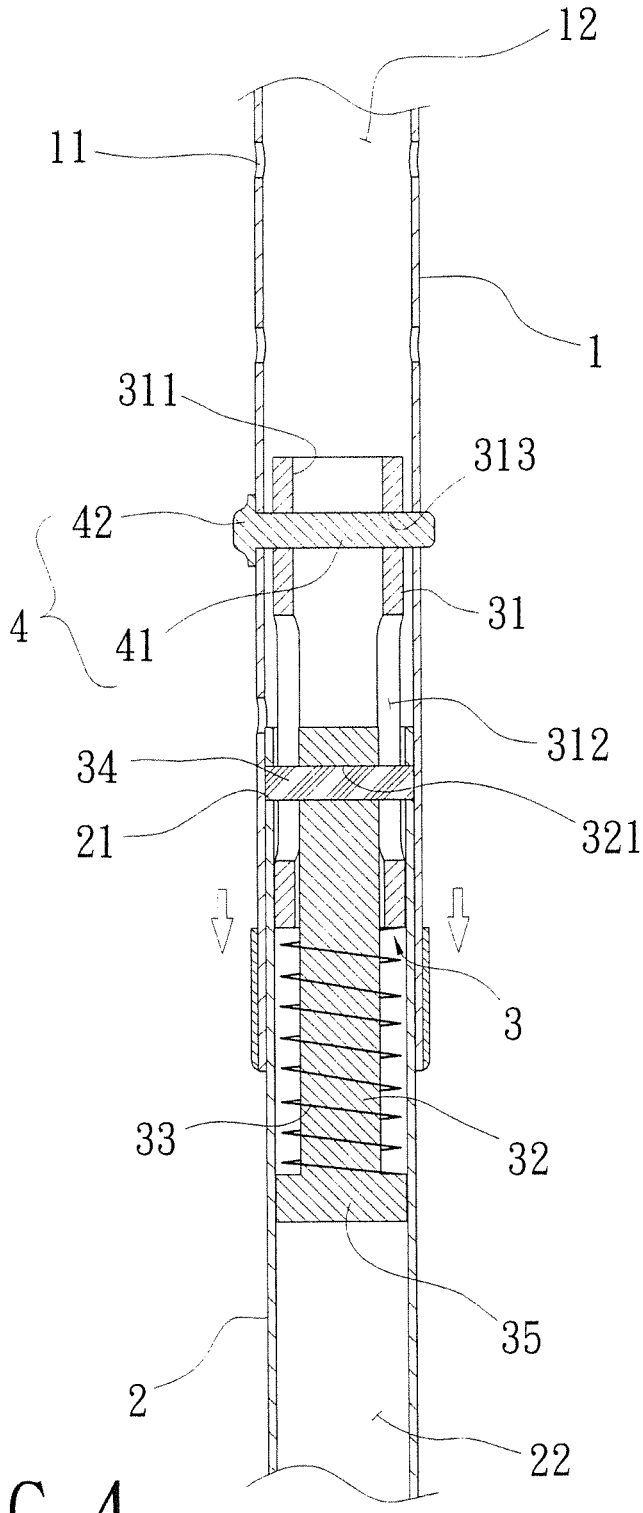
FIG. 4 is a state diagram showing the operation of an embodiment according to the present invention.

Next a downward pressure is applied to the main rod 1 when the user holds the handle part 13 of the main rod 1 to move the support pole 2 forward/backward or standing on the ground. Refer to FIG. 4, the sleeve 31 of the cushion unit 3 assembled with the main rod 1 is pressed downward, against the elastic body 33. By elastic compression of the elastic body 33, an elastic buffer force toward the main rod 1 is generated and a reaction force on the support pole 2 against the ground is eliminated so as to achieve vibration mitigation. After reduction of the reaction force, he cushion unit 3, the cushion unit 3 further reduces friction between user's hand and the handle part 13. Thus the users' hand will not have uncomfortable feelings caused by vibration after long term use. Users have more comfort and ease. Moreover, by the anti-slip block 23 on the bottom of the support pole 2 keeping contact with and against the ground, friction between the device and the ground is increased and the anti-slip effect is improved. Thus it's safer for users to use the ambulatory aid of the present invention while walking or standing.

In the present invention, the insertion pins 34, 41 respectively are used to fasten the cushion unit 3 on the support pole 2 and the main rod 1 firmly. Thus the structural strength is high and the cushion unit 3 will not come loose or fall out from the support pole 2 and the main rod 1 due to the large downward pressure from the user or the ground reaction force. Thus not only the service life of the ambulatory aid is increased, the safety in use is also improved. During the use of the ambulatory aid, the user will not fall down or lose body control due to movement of the support pole 2 and the main rod 1 caused by damaged or loose internal structure.

Figure 5:
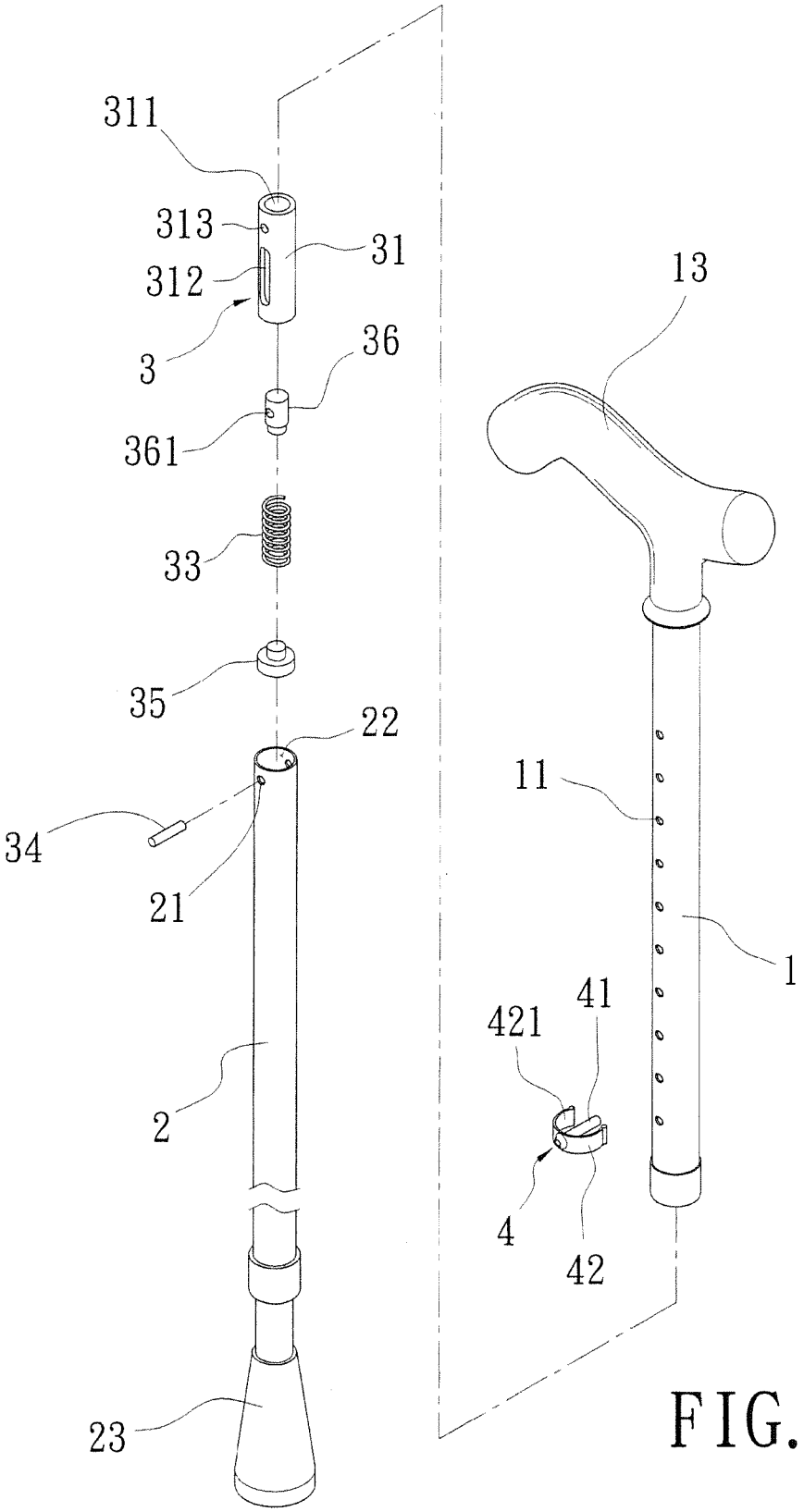
FIG. 5 is an explosive view of another embodiment according to the present invention.
Figure 6:
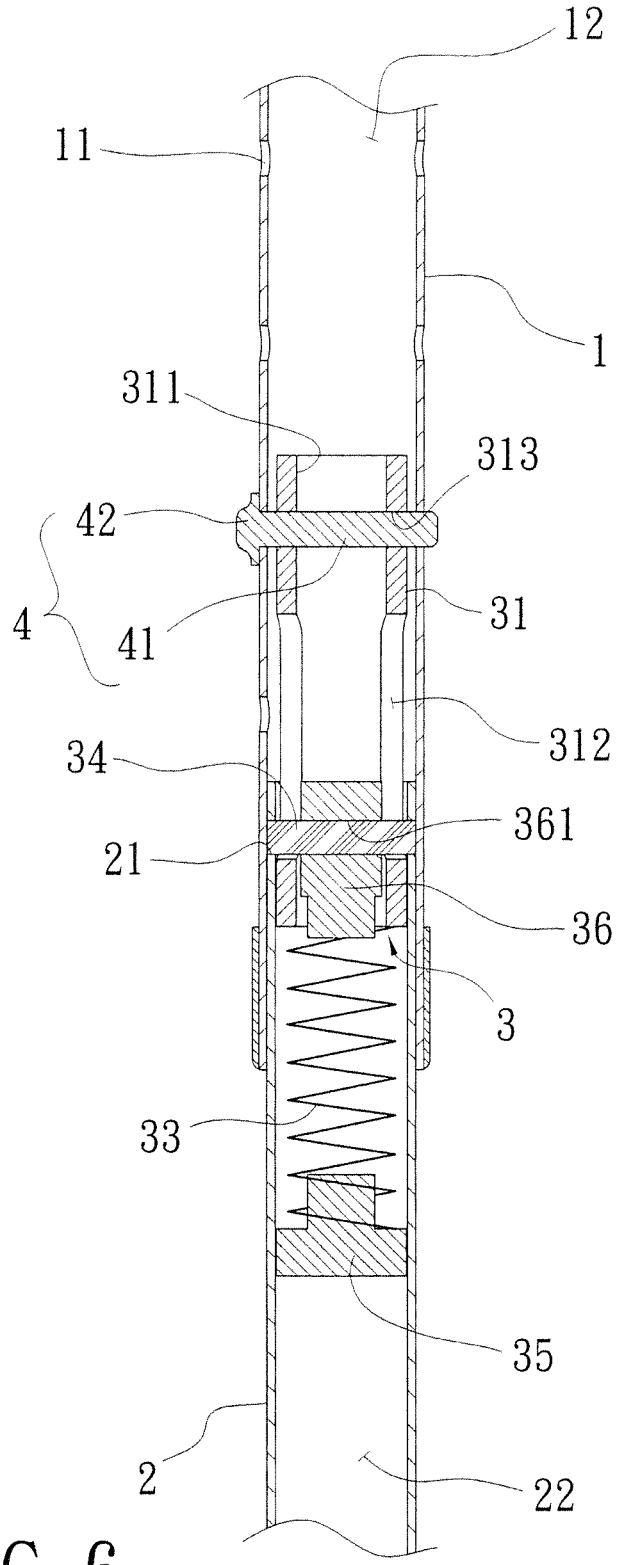
FIG. 6 is a partial cross sectional view of another embodiment according to the present invention.

Moreover, refer to FIG. 5 and FIG. 6, another embodiment is revealed. The assembly rod 32 of the cushion unit is replaced by an assembly block 36 with an insertion hole 361. The assembly block 36 is mounted into a hollow part 311 of a sleeve 31 and the insertion hole 361 is corresponding to slots 312 on each side of the sleeve 31. An insertion pin 34 is passed through the slots 312 of the sleeve 31 and the insertion hole 361 of the assembly block 36. And two ends of the insertion, pin 34 are inserted and mounted in insertion holes 21 on two sides of a support pole 2. An against block 35 is mounted in a hollow part 22 of the support pole 2 while an elastic body 33 is assembled with both the assembly block 36 and the against block 35 while two ends of the elastic body 33 are respectively leaning against the against block 35 and one end of the sleeve 31. Thereby the material is saved and the cost is down by the replacement of the assembly block 36 with the assembly rod 32 with similar structure strength and buffering effect.

Figure 7:
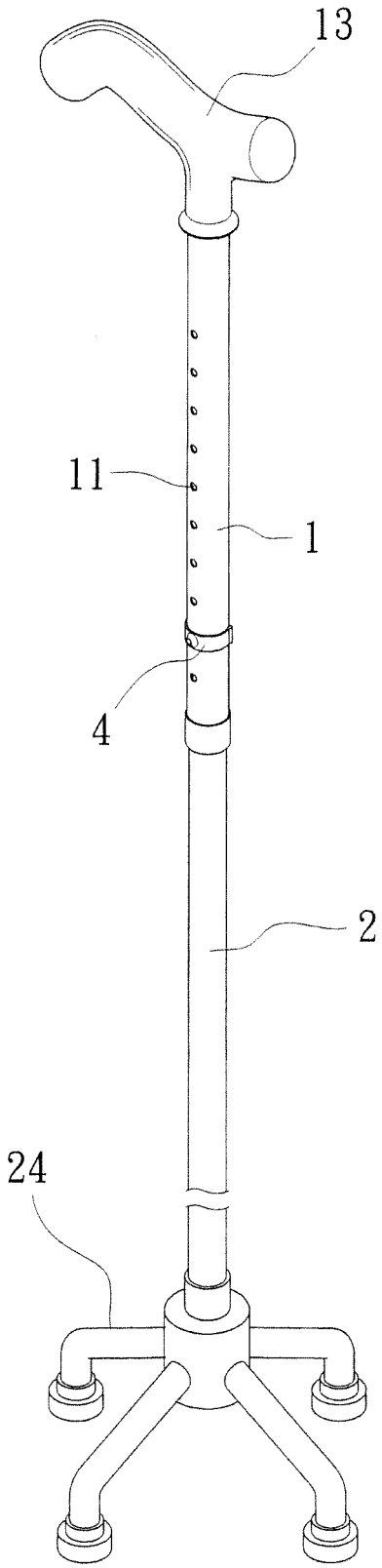
FIG. 7 is a perspective view of an embodiment according to the present invention.
Figure 8:
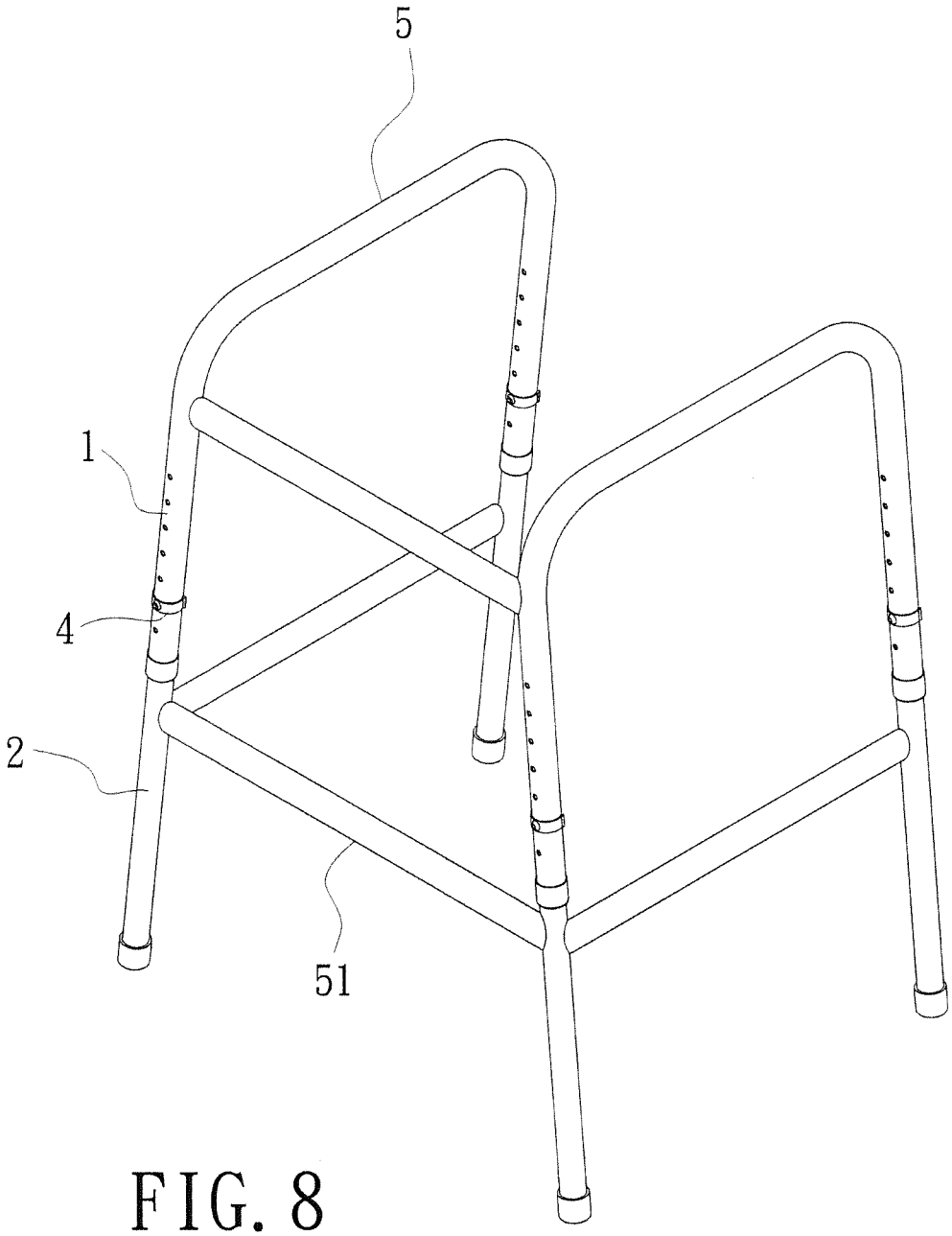
FIG. 8 is a perspective view of an embodiment according to the present invention.
Figure 9:
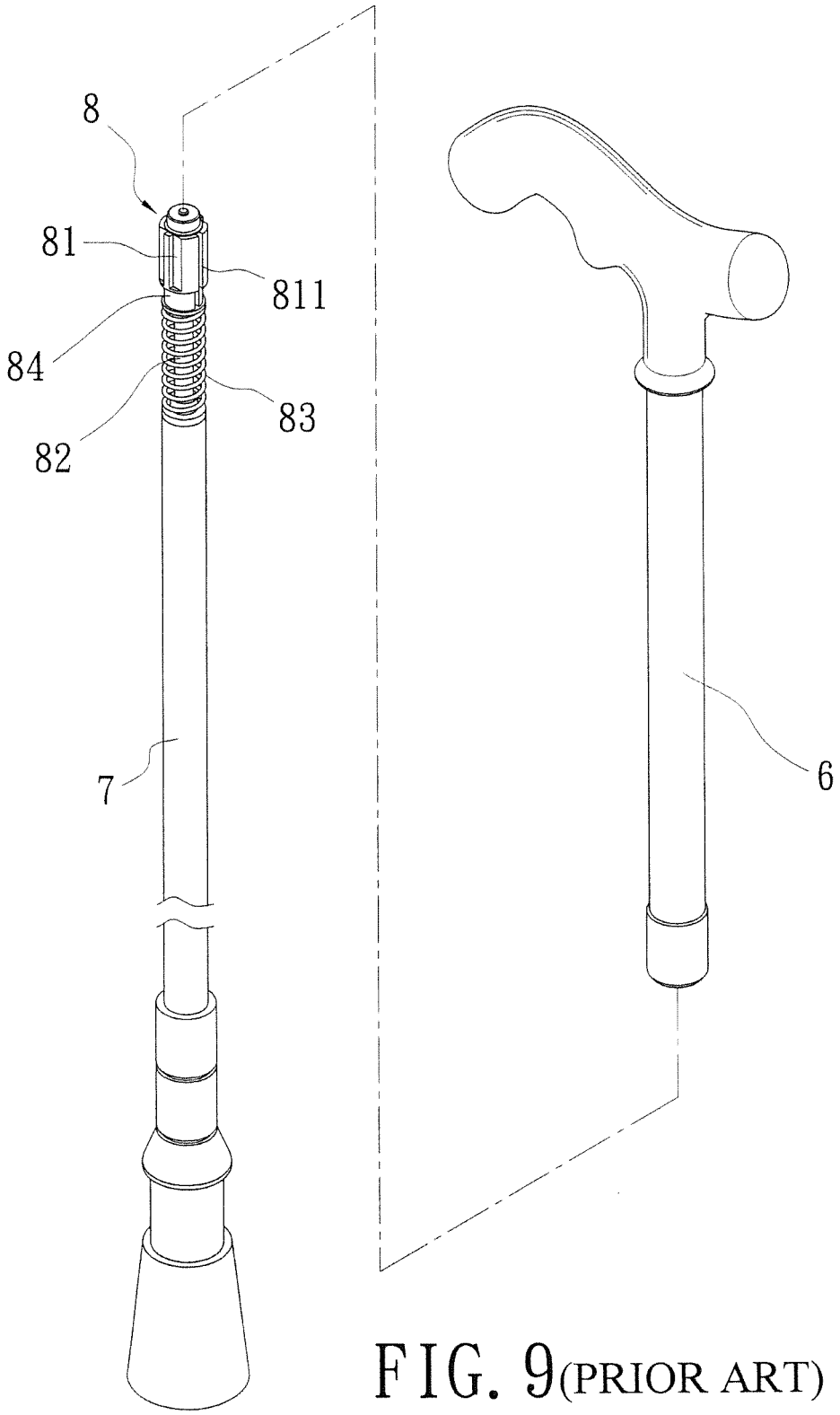
FIG. 9(PRIOR ART)
FIG. 9 is an explosive view of a prior art.

The structure or size of the present invention is not limited. Refer to FIG. 7, a radial frame 24 is arranged at the bottom of the support pole 2 for improving the stability of the support. As shown in FIG. 8, the present invention can also be applied to rods 51 of a walker 5.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An ambulatory aid comprising a hollow main rod arranged with a plurality of insertion holes, a hollow support pole sleeved into the main rod and having at least two insertion holes, and a cushion unit arranged between the support pole and the main rod;

wherein the cushion unit includes a sleeve, an assembly rod and an elastic body; the assembly rod is sleeved into the sleeve and one end of the assembly rod for being mounted into the sleeve is disposed with an insertion hole and two slots are respectively arranged at each of two sides of the sleeve; an insertion pin is inserted through the insertion holes of the support pole, the slots of the sleeve and the insertion hole of the assembly rod; the other end of the assembly rod extended from the sleeve is sleeved into the support pole and is arranged with an against block; the elastic body is placed around the assembly rod and two ends of the elastic body are respectively against the against block of the assembly rod and one end of the sleeve; the other end of the sleeve arranged with insertion holes is mounted into the main rod; the insertion holes of the sleeve are corresponding to the insertion holes of the main rod and another insertion pin is inserted through the insertion holes of the main rod and the insertion holes of the sleeve.

2. The device as claimed in claim 1, wherein the insertion holes of the main rod are arranged vertically.

3. The device as claimed in claim 1, wherein one end of the insertion pin inserted through the insertion holes of the main rod and the insertion holes of the sleeve is disposed with a holding block.

4. The device as claimed in claim 3, wherein the holding block is C-shaped and is having an open part that is attached closely to the main rod.

5. The device as claimed in claim 1, wherein a handle part is arranged at a top of the main rod.

6. The device as claimed in claim 5, wherein an anti-slip block is disposed on a bottom of the support pole.

7. The device as claimed in claim 5, wherein a radial frame is arranged at a bottom of the support pole.

8. The device as claimed in claim 1, wherein the ambulatory aid is disposed on at least one rod of a walker.

9. An ambulatory aid comprising a hollow main rod arranged with a plurality of insertion holes, a hollow support pole sleeved into the main rod and having at least two insertion holes, and a cushion unit arranged between the support pole and the main rod;

wherein the cushion unit includes a sleeve, an assembly block and an elastic body; the assembly block is sleeved into the sleeve and one end of the assembly block for being mounted into the sleeve is disposed with an insertion hole and two slots are respectively arranged at each of two sides of the sleeve; an insertion pin is inserted through the insertion holes of the support pole, the slots of the sleeve and the insertion hole of the assembly block; an against block is mounted in the support pole while the elastic body is placed around the assembly block and two ends of the elastic body are respectively against the against block and one end of the sleeve; the other end of the sleeve arranged with insertion holes is mounted into the main rod; the insertion holes of the sleeve are corresponding to the insertion holes of the main rod and another insertion pin is inserted through the insertion holes of the main rod and the insertion holes of the sleeve.

10. The device as claimed in claim 9, wherein the insertion holes of the main rod are arranged vertically.

11. The device as claimed in claim 9, wherein one end of the insertion pin inserted through the insertion holes of the main rod and the insertion holes of the sleeve is disposed with a holding block.

12. The device as claimed in claim 11, wherein the holding block is C-shaped and is having an open part that is attached closely to the main rod.

13. The device as claimed in claim 9, wherein a handle part is arranged at a top of the main rod.

14. The device as claimed in claim 13, wherein an anti-slip block is disposed on a bottom of the support pole.

15. The device as claimed in claim 13, wherein a radial frame is arranged at a bottom of the support pole.

16. The device as claimed in claim 9, wherein the ambulatory aid is disposed on at least one rod of a walker.

* * * * *